US006127082A

United States Patent [19]

Humberstone et al.

[11] Patent Number: 6,127,082

[45] Date of Patent: Oct. 3, 2000

[54] APPARATUS AND METHOD FOR SUPPLYING MATERIAL TO A SUBSTRATE

[75] Inventors: Victor Carey Humberstone; Andrew Jonathan Sant; David Mark Blakey; Peter John Taylor; Richard Wilhelm Janse Van Rensburg, all of Cambridge, United Kingdom

[73] Assignee: TCC Group PLC, Hertfordshire, United Kingdom

[21] Appl. No.: 08/983,354

[22] PCT Filed: Jul. 11, 1996

[86] PCT No.: PCT/GB96/01671

§ 371 Date: Jan. 12, 1998

§ 102(e) Date: Jan. 12, 1998

[87] PCT Pub. No.: WO97/02903

PCT Pub. Date: Jan. 30, 1997

[30] Foreign Application Priority Data

Jul. 13, 1995 [GB] United Kingdom ..... 9514335

[51] Int. Cl.[7] ..... G03G 9/125; G03G 15/10; B41J 2/06; B05D 1/04

[52] U.S. Cl. ..... 430/117; 430/119; 399/241; 399/246; 347/55; 347/68; 347/70; 347/112; 427/458; 427/466; 427/469; 427/483; 118/621; 118/627

[58] Field of Search ..... 430/117, 119; 427/458, 466, 469, 483; 399/241, 246; 118/621, 627; 347/55, 68, 70, 112

[56] References Cited

U.S. PATENT DOCUMENTS

| | | | |
|---|---|---|---|
| 3,606,531 | 9/1971 | Gourdine | 430/62 |
| 3,795,443 | 3/1974 | Heine-Geldern et al. | 430/117 |
| 3,967,549 | 7/1976 | Thompson et al. | 347/125 |
| 3,977,323 | 8/1976 | Pressman et al. | 347/55 |
| 4,023,898 | 5/1977 | Ohno et al. | 399/238 |
| 4,126,711 | 11/1978 | Marlow | 430/103 |
| 4,833,505 | 5/1989 | Furuya et al. | 399/231 |
| 5,752,142 | 5/1998 | Staples et al. | 399/241 |

FOREIGN PATENT DOCUMENTS

| | | | |
|---|---|---|---|
| A-2240494 | 8/1991 | United Kingdom | B05B 11/02 |
| A-2263076 | 6/1994 | United Kingdom | B05B 11/02 |
| WO A 9310910 | 6/1993 | WIPO | B05B 17/06 |
| 95/10800 | 4/1995 | WIPO | G03G 15/10 |
| WO A 9515822 | 6/1995 | WIPO | B05B 17/06 |

*Primary Examiner*—Bernard Codd

*Attorney, Agent, or Firm*—Watson Cole Grindle Watson, P.L.L.C.

[57] ABSTRACT

An apparatus and method are described for supplying material to a substrate (109). The apparatus includes a member (3) having a surface with a plurality of features (8) which locate, in use, menisci of a liquid (1) supplied to the member. An actuator (4) induces mechanical vibrations within the liquid located by the features to cause liquid droplets (7) to be sprayed. Liquid (1) is supplied to the member and electrical charge is supplied to the member and electrical charge is supplied to the liquid by, for example, an electrode (14). Electrical charge or potential is also supplied to the substrate (109) so that the droplets are directed towards the substrate to deposit material thereon.

49 Claims, 10 Drawing Sheets

Figure 1A:
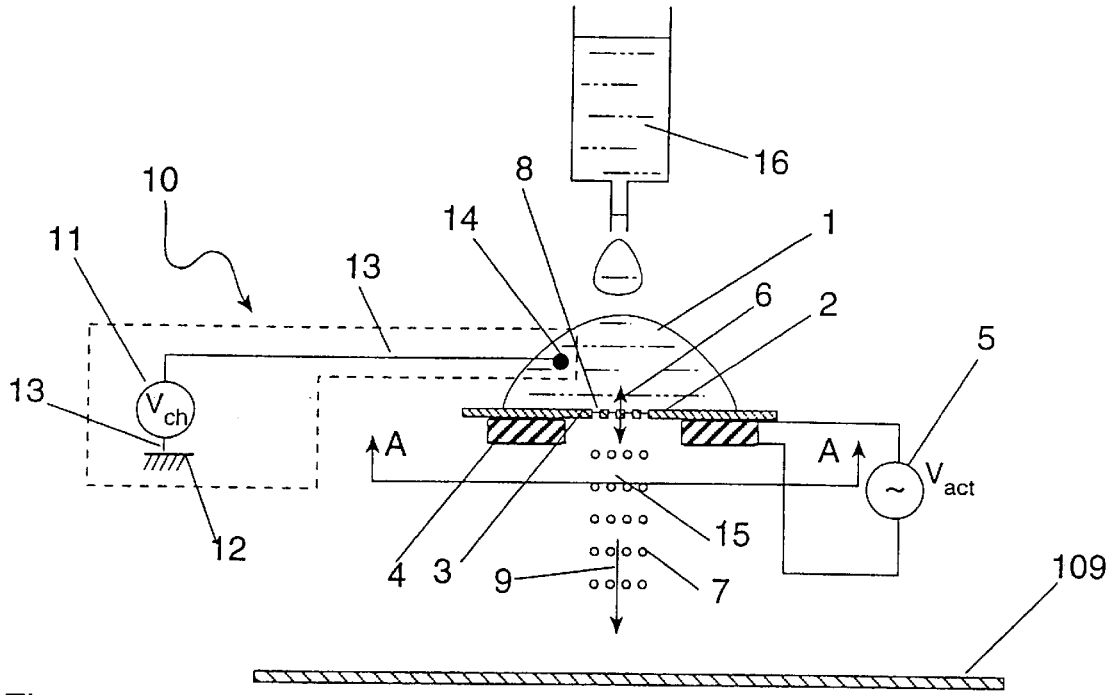

Plan view A-A of Figure 1a

APPARATUS AND METHOD FOR SUPPLYING MATERIAL TO A SUBSTRATE

This invention relates to an apparatus and method for the supply of liquid droplets and/or solids that are at least initially carried by liquid droplets, the droplets having an electrical charge. More particularly, the invention relates to the supply of liquids and/or solids into a gaseous environment.

The invention further relates to an apparatus and method for supplying liquid and/or solids to a substrate having upon or below its surface an electrical charge or potential, including cases where that electrical charge or potential is in the form of a spatial pattern within the surface area presented by the substrate to the droplets or solids.

In this specification we refer as 'liquids' to the following: pure liquids, mixtures of pure liquids, solutions of solids and suspensions of particulate solids in any of the above. The term 'liquid droplet' is similarly to be understood to include droplets of mixtures, solutions and suspensions as well as of pure liquids. In the case of solutions where we wish to refer specifically to the solvent rather than the solute, and in the case of suspensions where we wish to refer to the suspending liquid rather than the suspensate, we refer to the 'carrier liquid'.

In this specification we also refer to liquid 'conductivity'. By this we mean the ability to conduct an electrical current through the liquid from electrodes at differing electrical potentials immersed in the liquid. This includes the motion of charged solute or suspensate species (including solid particles) within the carrier liquid, which current would not occur in the absence of such species.

It is known to deposit liquids and/or solids materials on to substrates, the liquids and/or solids materials being carried to those substrates in the form of droplets of liquid (as herein defined) or of powdered solids. Applications include: the coating of moving sheets of substrate material, for example, to manufacture products such as adhesive tapes; the deposition of protective layers upon functional substrates otherwise vulnerable to their environment; and to confer specific properties or modify the properties of the substrate material, for example, coatings that control the release of a drug from a drug-containing matrix, the application of toner material in electrographic process, etc.

In some of these arts, for example in the electrographic and electrophotographic imaging arts, it is desired that the deposition of such airborne droplets (or powder solids in the case of evaporation of the carrier liquid before arrival at the substrate) on a substrate is responsive to a pattern of electrical charge or potential on or below the surface of that substrate. To enable this, it is generally required to provide the droplets with an electrical charge. For faithful deposition according to the pattern of electrical charge or potential of the substrate it is also generally required that the droplet inertia should not be too large (in relation to the electrostatic forces exerted on the droplets by the charge or potential pattern of the substrate), so that the motion of the charged droplets towards the substrate is responsive to the electrostatic forces between the substrate and the droplets and is not primarily governed by the momentum with which the droplets (or powder solids) enter the region proximate to the substrate. (This is also desirable, though less critical, in the case of deposition upon substrates whose charge or potential is uniform over the surface area of the substrate presented to the droplets.) In this way so called 'imagewise development' known in the electrographic imaging and printing arts that renders visible a pre-written pattern of electrical charge by droplets containing opaque solids particles or dyes has been achieved. Particular examples are described in U.S. Pat. Nos. 3,005,726 (Olson); 2,690,394 (Carlson); 3,532,495 (Simm); 3,795,443 (Heine-Geldern). In other arts, it may not be an object that a visible mark is made by the pattern of solids remaining after evaporation of the carrier liquid.

Hitherto, however, whilst known spray deposition methods are capable of depositing droplets according to a pattern of charge or potential, various drawbacks have limited their adoption for applying toners in the electrographic imaging and printing arts and for applying liquids or solids upon substrates in other deposition arts.

In many applications a high density of droplets in the surrounding gas (usually air) is often desired so that the process can be rapid. The freedom to use liquids of a wide range of electrical conductivity is also desired, to give greatest applicability. It is generally desired for the apparatus to be simple, compact, and low in cost to allow commercial use in a wide range of applications. Finally, especially in electrographic imaging and printing applications, it is desirable to produce small droplets (typically less than 40 $\mu$m in diameter) in order that their arrival on the substrate surface can accord with the fine detail of the charge image. In such applications the electrical charge upon the substrate is often (although not always) somewhat limited, a finite quantity of charge having been deposited on insulating substrates by sources such as corotrons. It is correspondingly desirable for the droplets to have a well-controlled ratio of electrical charge to mass. Separate control over droplet size and charge level is therefore desirable.

Existing methods of aerosol production, including electrostatic atomisation, continuous ink jet (CIJ), ultrasonic atomisation and pressurised spray nozzles are unsatisfactory in various ways for such applications.

In the electrostatic spray deposition art the droplet formation and charging processes are inextricably linked. It is therefore difficult or impossible separately to control the charge and the size or inertial behaviour of droplets so generated. Even though large electrostatic fields are employed to generate the droplets (generally by electrodes at high electrical potential in front of the liquid meniscus), the initial inertia of the droplets so produced is of such magnitude that they escape from these very high electrostatic fields with considerable retained inertia. This makes the kinetic response of such droplets to the generally weaker electrostatic fields of charge patterns formed on substrates rather poor. Consequently electrostatic spray deposition, to the knowledge of the inventors, has hitherto been limited to deposition onto substrates having little or no spatial variation in the pattern of charge or potential within the surface area presented by the substrate to the droplets. Further, electrostatic droplet generation is rather sensitive to the electrical conductivity of the carrier liquid, so limiting its practical utility. One successful application of electrostatic spray deposition has been spray painting, but no practical geometries to produce high densities of droplets for rapid 'imagewise' deposition (as described above) in compact equipment is known to the inventors and electrostatic spray deposition has not found general application in higher-resolution deposition, such as electrographic printing.

Continuous ink jet (CIJ) devices issue a jet of pressurised liquid from each of many orifices, which jets break up into droplets under the influence of a vibration source. Droplet separation generally occurs in the vicinity of an 'induction electrode'. A separate such induction electrode is positioned in front of each orifice and induces charge to flow into each jet and thence into each forming droplet. CIJ devices therefore separate the droplet formation and charging processes, giving greater control. However, they employ individual electrostatic control of the charging of each separate jet. To the knowledge of the inventors, such devices designed to deposit droplets on substrates according to the droplet charge produce relatively large droplets (typically 60–100 μm diameter) at relatively low frequencies (typically less than 150 kHz droplet generation rate per orifice). The inertia of each charged individual droplet is again sufficient reliably to escape the electrostatic attraction of the 'induction electrode'. On entering the region proximate to a substrate (having upon or below its surface a pattern of electrical potential or charge), it is again difficult to arrange that the droplet motion towards the substrate is primarily governed by the electrostatic forces exerted on the droplets by the electrostatic field pattern presented by the substrate. Ultimately of course, the viscous drag of the air can slow such droplets down sufficiently that they can respond to such electrostatic field patterns. However, this requires large distances between droplet generation and substrate, so that compact apparatus is not provided; further the large droplet inertia makes their response slow. It is also found that gravitational settling of the relatively massive droplets, rather than purely 'imagewise development', can occur. Still further, on arrival at the substrate a large 'mark', corresponding to the large droplet size, is produced. CIJ techniques known to the inventors therefore do not enable imagewise development in compact apparatus and in particular do not enable deposition according to charge or potential patterns of high spatial frequency.

Ultrasonic atomisation from unconstrained liquid surfaces (as described for example by Rozenberg in *Physical Principles of Ultrasonic Technology,* published by Plenum) may be integrated with electrodes to impress charge upon droplets as or after they are generated (see for example U.S. Pat. No. 2,690,394, Carlson). These methods create a high initial density of droplets and can produce small droplets. However their wide initial droplet size distribution generally require means to select the desired size fraction, which results in a low density of droplets at the final substrate and in bulky equipment. These ultrasonic atomisation methods generally produce sprays in the form of a near-stationary 'mist' above the liquid surface (see for example U.S. Pat. No. 3,795,443, Heine-Geldern), so that droplet charging by means of an induction electrode such as that described for continuous ink jet printing above is unsatisfactory—insufficient numbers of the droplets then have sufficient inertia to escape the electrostatic field of the induction electrode for effective utilisation of the liquid. Recovery of such 'wasted' liquid from the electrode is also generally required.

Pressurised nozzle systems also produce wide droplet size ranges and excessive droplet velocities.

As a result of these problems, particularly but not exclusively in the electrographic imaging and printing arts, the aerosol method for depositing liquids and/or solids has not been extensively adopted.

An object of the present invention is to overcome various problems associated with the prior art charged-droplet supply apparatus.

A further object is to provide apparatus capable to supply, in the form of charged droplets and to substrates having upon or below their surface an electrical charge or potential, liquids and/or solids whose deposition upon said substrate is responsive to said substrate charge or potential. The charge or potential on the substrate may be disposed in a pattern.

According to a first aspect of the present invention there is provided apparatus for supplying material to a substrate, said apparatus comprising:

a member having a surface, a plurality of features at said surface for locating at said surface, in use, menisci of a liquid supplied to said member;

liquid supply means for supplying liquid to the member;

means for supplying electrical charge to the liquid;

an actuator for inducing mechanical vibrations within the liquid located by said features to cause charged liquid droplets to be sprayed from said member; and means for providing electrical charge or potential to the substrate, whereby said charged droplets are directed towards said substrate to deposit said material thereon.

In the context of the present specification when reference is made to supplying electrical charge or potential "to" the substrate it is to be understood that this means either directly to the surface of the substrate or above or below it.

The invention also includes a method of supplying material to a substrate, said method comprising:

supplying liquid to a member having a surface, said surface having a plurality of features locating menisci of said liquid at said surface;

inducing mechanical vibrations within the liquid located by said features and causing liquid droplets to be sprayed from said member;

supplying electrical charge to the liquid; and providing electrical charge or potential to the substrate, whereby said droplets are directed towards said substrate to deposit said material thereon.

The supply of liquid to the member may be "on-demand", in other words replenishing, so that liquid is supplied to match the spray of droplets from the member.

The features may be in the form of orifices capable of allowing liquids (as herein defined) to pass through them. Conveniently, though not necessarily, the member will take the form of a perforate plate or membrane, the orifices or, equivalently, perforations extending between two substantially parallel faces of such a plate or membrane. The orifices may be permanently open or closable when liquid is not passing through them (for example if the member is a rubber or similar membrane). The liquid will typically be brought to one face of that plate or membrane.

For ease of reference only, the present invention will be described hereinafter by reference only to such perforate plates or membranes, which forms in the experience of the inventors convey greatest advantage. Application to other forms of member incorporating orifices or other features, eg. surface relief formations, such as those described in EP-A-0615470, is to be understood.

The means for supplying charge or potential to the liquid may supply free charge conductively through the liquid before or as the droplets are generated; alternatively the means for supplying charge may supply free charge to the droplets once formed; both as further discussed below.

Further alternatively, in the case where the liquid itself contains charged species, the 'on-demand' or replenishing supply of liquid may itself be used to bring further charge to liquid adjacent to the perforate region of the plate and thence to the droplets.

In use the perforate region of the plate is contacted on one face (hereinafter termed the 'rear' face) by bulk liquid and is contacted on the opposing face (the 'front' face) by a gaseous medium, usually air. However, hereinafter wherever the term air is used gases generally are to be understood as included.

Vibration of the element or plate by the actuator, particularly at ultrasonic frequencies, induces liquid to pass through the orifices and to emerge from the front face as individual droplets moving through the air away from the plate or element. In particular, the simultaneous ejection of multiple droplets creates a cooperative droplet transport effect, particularly in the region immediately in front of the perforate plate (and in which region an optional 'induction electrode' may be situated), that enables droplets to be charged by and to 'escape' from the apparatus, and yet for those droplets to present low inertia in relation to the electrostatic forces exerted upon them by a substrate having upon or below its surface a pattern of electrical charge or potential.

This desirable effect is particularly marked in the case of small droplets (of diameter less than, say, 40 $\mu$m and of more typical diameter 5 $\mu$m–20 $\mu$m) ejected with initial velocities in the range 5 to 15 meters per second at an initial spacing (in the plane transverse to the direction of ejection) typically in the range of 200–500 $\mu$m.

The mechanisms involved in the operation of the apparatus and method of the invention are believed to be as follows:

Consider first droplet ejection. Such typical small droplets, if ejected from single orifices or perforations, are rapidly decelerated by the air, coming to near-stationary motion very close to the ejecting perforation (generally within a few millimeters). For example, use of induction charge electrodes, as in conventional CIJ apparatus, with such small droplets is not expected to allow droplets reliably to escape from the strong electrostatic fields of the induction electrode.

However, it has been found that the use of multiple closely-spaced orifices or perforations, all ejecting droplets simultaneously, produces a droplet stream upon which the effects of viscous deceleration by air are greatly reduced. It is believed by the inventors that the viscous drag can now act effectively only upon the outer surface of the overall droplet stream, not upon individual droplets, and that such a droplet stream has sufficient initial momentum to entrain air flow with the droplet stream. In this way the initial viscous drag experienced by the droplets is reduced and so, despite their low size, they can be transported away from the apparatus. Indeed, in the case of charging of such droplets by means of an induction electrode, the great majority of such droplets in such a droplet stream can now escape past the induction electrode whereas, if the droplets were ejected from a single orifice or perforation (but otherwise under the same conditions), many would be captured by the induction electrode.

Consider next droplet deposition upon substrates having upon or below their surface a pattern of charge or potential. The charged droplets within the ejected droplet stream produced by the claimed apparatus incorporate air within the stream, initially slowly. If charged with a single sign of charge, which is generally desirable, they also repel each other electrostatically. Both effects cause the droplet stream to spread sideways (i.e. substantially perpendicular to their direction of travel), and thereby to encounter and incorporate more and more air within the droplet stream. The droplets thereby (and aided by their small mass) rapidly decelerate, having greatly reduced velocities a short distance away from the perforate plate (between 5 and 15 centimeters for typical embodiments) in the form of a dense 'cloud' of droplets. In this condition the low inertia of the droplet cloud allows droplet migration to the substrate that is highly responsive to the electrostatic field pattern that the substrate presents to the droplets. This enables faithful deposition according to that pattern.

Charge may, for example, be impressed upon the ejected droplets of conductive liquids brought to the perforate plate by an imposed electric field in the airspace (in general taken to mean 'gas space' in the application) at or closely in front of or behind the perforate plate, together with electrical contact of the water to a source of free charge.

Free charge may also be brought to the ejected droplets by exposing them to an ion source such as a corotron or an 'electrogasdynamic' source such as that described in U.S. Pat. No. 3,606,531. Such methods are independent of the conductivity of the droplet itself and so allow charging of electrically insulating liquid droplets.

As a third example, electrical charge may be brought by a replenishing supply of liquid that replaces liquid ejected as droplets. Examples include both conducting liquids such as aqueous solutions and suspensions, and insulating liquids carrying separated charge species within them. An example of the latter is 'liquid toner' as known from and used in the electrographic imaging and printing and printing arts. Such liquids which generally comprise an insulating carrier liquid, such as an iso-paraffin, carrying solid pigment particles ('toner particles') in suspension and optional further materials such as so-called 'charge control agents'. The general electrical configuration of such liquids is that in which the toner particles acquire a net charge relative to the carrier liquid while the overall liquid remains electrically neutral.

Finally, in the case of insulating carrier liquids, the droplets may be triboelectrically charged by the passage of the liquid through the perforations of the plate or relative to other surface features that locate the liquid menisci.

The present invention thereby combines the virtues of providing charged droplets with sufficiently low inertia and small droplet size that they deposit according to the pattern of electrostatic field presented by a deposition substrate, including the case where that pattern has high spatial resolution, all from compact simple apparatus.

In addition: (i) the apparatus is not strongly sensitive to the conductivity of the liquid, and can operate with liquids of a wide range of surface tensions and a range of viscosities at least comparable to other techniques, (ii) in some implementations the size of the perforations has a marked influence on the size of the emitted drople; fabrication of plates with uniform hole size therefore contributes to formation of a droplet stream with the desired narrow size distribution and by this means allows separate control over droplet size and charge, (iii) unlike prior art ultrasonic droplet generation devices having an unconstrained free surface, the perforate structure of the plate allows droplet ejection to occur with 'droplet-emitting' points that may be controlled separately from droplet size. Inter-droplet collisions can thereby be suppressed, better maintaining a relatively narrow size distribution as the droplets move through the gaseous medium. Sufficiently high density can however still be maintained for rapid deposition upon substrates, and in particular for rapid imagewise development of charge images in the electrographic arts.

In particular the inventors find that high conductivity liquids such as aqueous liquids, including aqueous liquid toners, can be satisfactorily ejected as charged droplets by such apparatus, and that these can subsequently be deposited upon substrates according to a pattern of electrical charge or potential upon on below the surface of the substrate.

The means for providing a pattern of electrical charge or potential upon or below the surface of the substrate upon which the liquids and/or solids are to be deposited may be any of the conventional means known in the electrostatic spraying of electrographic imaging and printing arts. Examples include: (i) the connection of conducting substrates to a source of electrical potential; (ii) the deposition of conducting layers upon electrically insulating substrates in the pattern corresponding to which liquid and/or solids deposition is desired and then the connection of said conducting layers to a source of electrical potential or applying to said layers an electrical charge; and (iii) the use of so-called 'corotrons', 'ionographic heads', 'electrogasdynamic' ion generators or radioactive decay sources to supply free ions in the air that deposit on the surface of said substrate. Where these are incapable directly of writing a pattern of charge but deposit only unpatterned charge, they may be used in conjunction with substrates made of photoconductive or photoresistive material such that pre-charging or post-charging exposure of the surface of the substrate to a light pattern results in the deposited charge also forming a corresponding pattern.

Forms of the perforate plate droplet generation elements of the apparatus described herein that are believed suitable include those disclosed in: GB-B-2,240,494; GB-B-2,263,076; GB-A-2,272,389; EP-A-0,655,256; WO-A-92/11050; EP-A-0,480,615; EP-A-0,516,565; WO-A-93/10910; WO-A-95/15822; WO-A-94/22592; U.S. Pat. No. 4,465,234; U.S. Pat. No. 4,533,082; U.S. Pat. No. 4,605,167; WO-A-90/12691; U.S. Pat. No. 4,796,807; WO-A-90/01977; U.S. Pat. No. 5,164,740; U.S. Pat. No. 5,299,739; the entire content of which disclosures is hereby incorporated by reference.

The presently preferred form of perforate-plate droplet generator for use with the present invention known to the inventors is described in WO-A-95/15822. This device has the capability to deliver relatively small droplets from relatively large perforations and allows delivery of suspensions of solids particles within carrier liquids as very small diameter droplets (for example, less than 10 $\mu$m diameter) without those solids inducing blockage of the perforations. This is beneficial in applications such as image-wise delivery of toner suspensions in electrophotographic imaging and printing applications. This also allows the use of plates or membranes with hole sizes that are relatively easy to fabricate and thus relatively inexpensive.

Figure 1B:
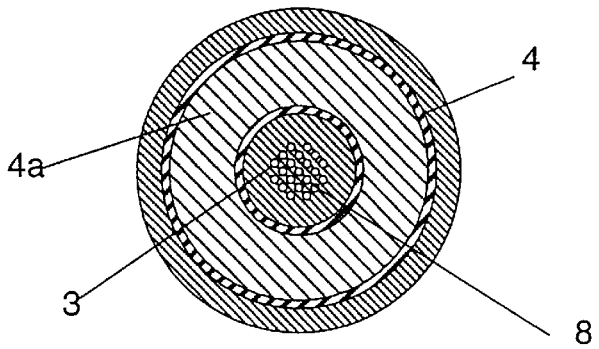
Figure 1C:
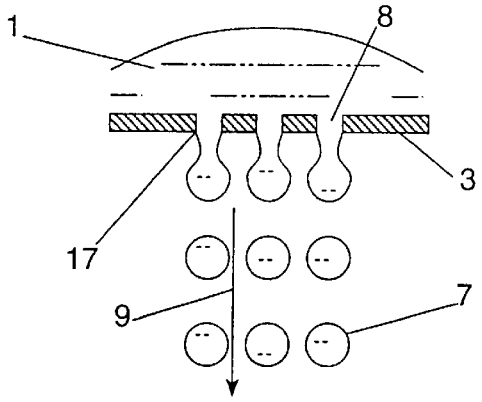
Figure 1D:
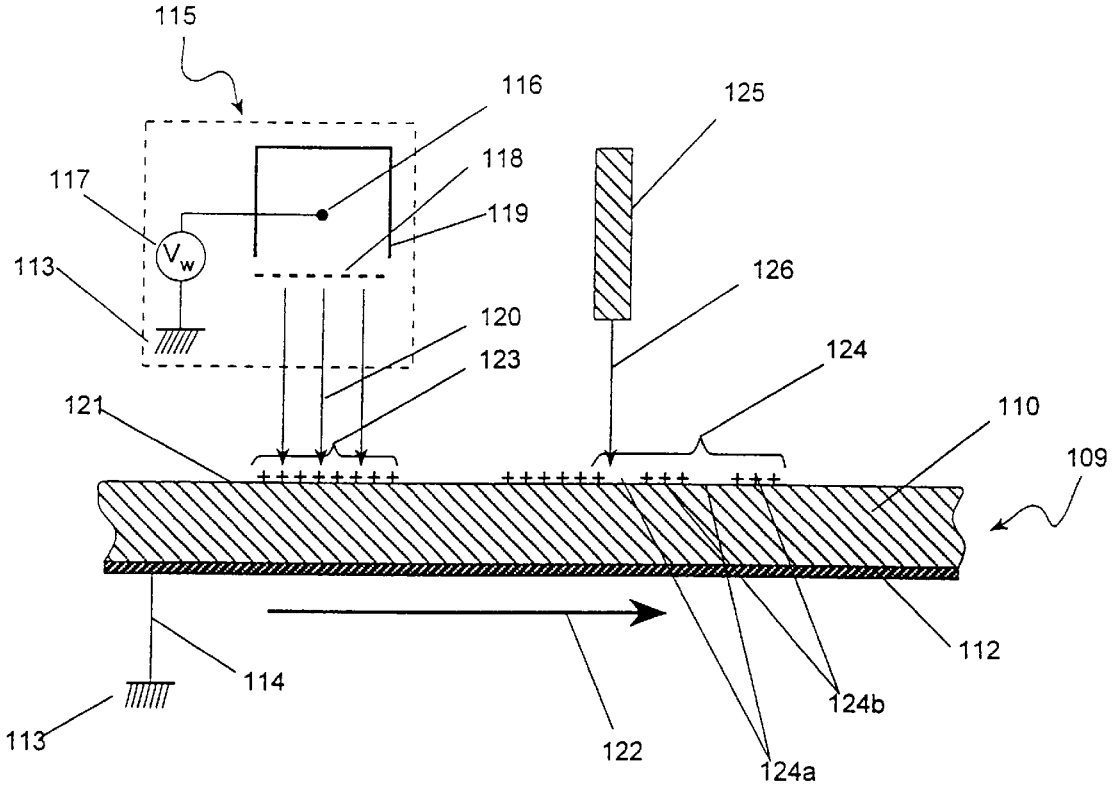

Preferred embodiments of the invention will now be further described by way of example only and with reference to the accompanying drawings, in which:

FIGS. 1*a*, 1*b:* show sectional and plan views of a droplet dispensation and charging apparatus FIG. 1*c:* shows a partial enlargement of FIG. 1*a,* illustrating the circumscribing of the menisci of liquid sprayed from the apparatus by orifices in a perforate plate or membrane FIG. 1*d:* shows an example of a means for providing electrical charge or potential to the substrate shown in FIG. 1*a*

Figure 2A:
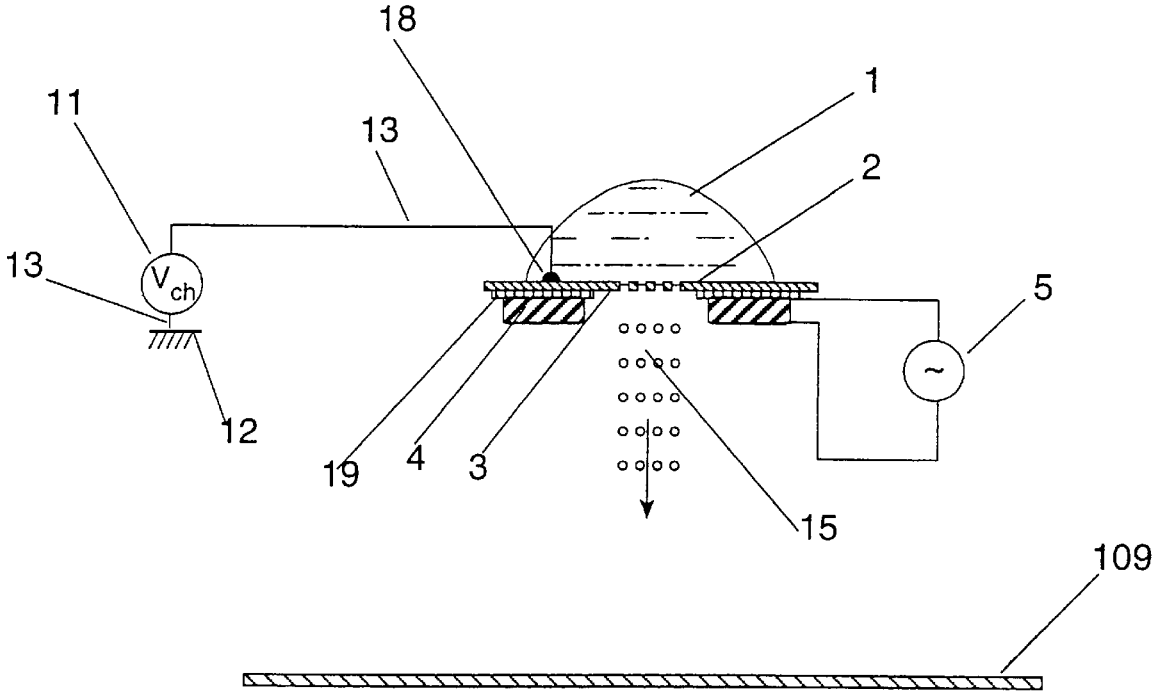
Figure 2B:
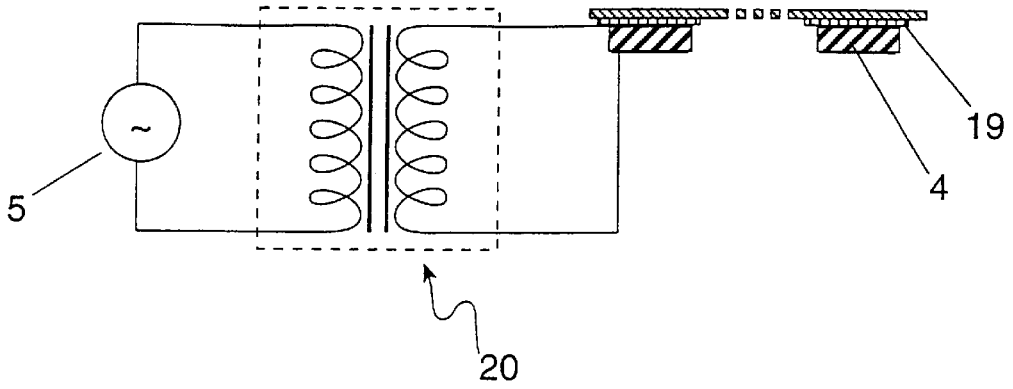

FIG. 2*a:* is a sectional view of a second droplet dispensation and charging apparatus FIG. 2*b:* is an electrical circuit suitable for exciting vibration in the apparatus according to any of FIGS. 1 to 13

Figure 3:
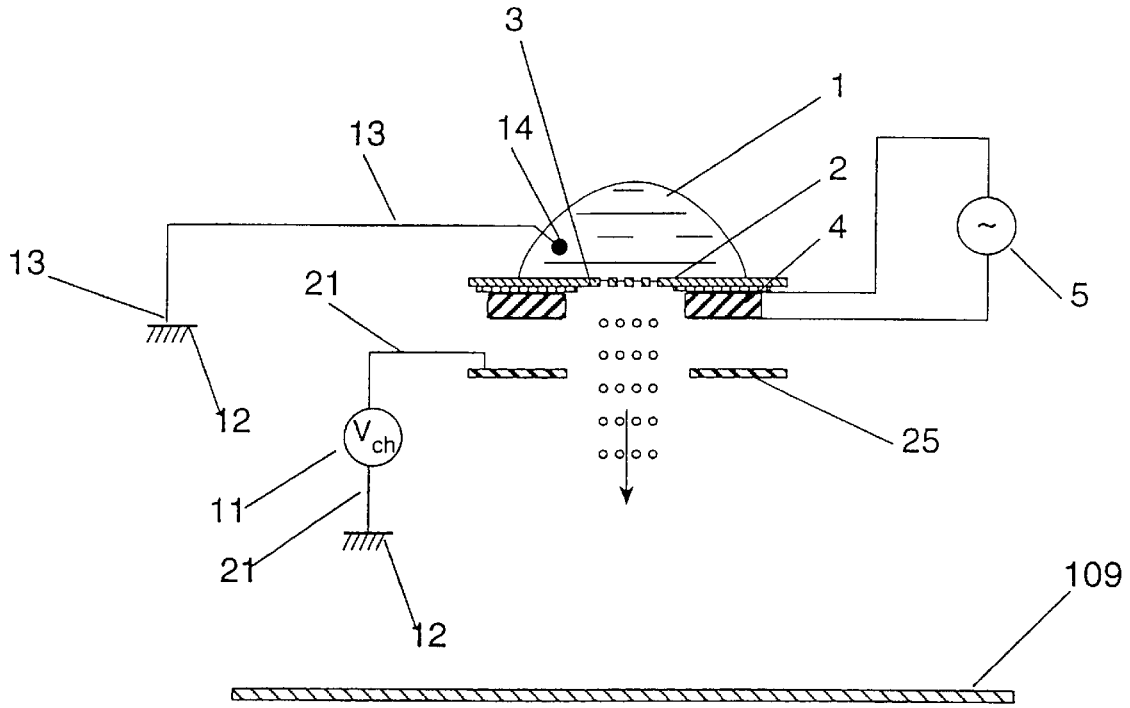
Figure 4:
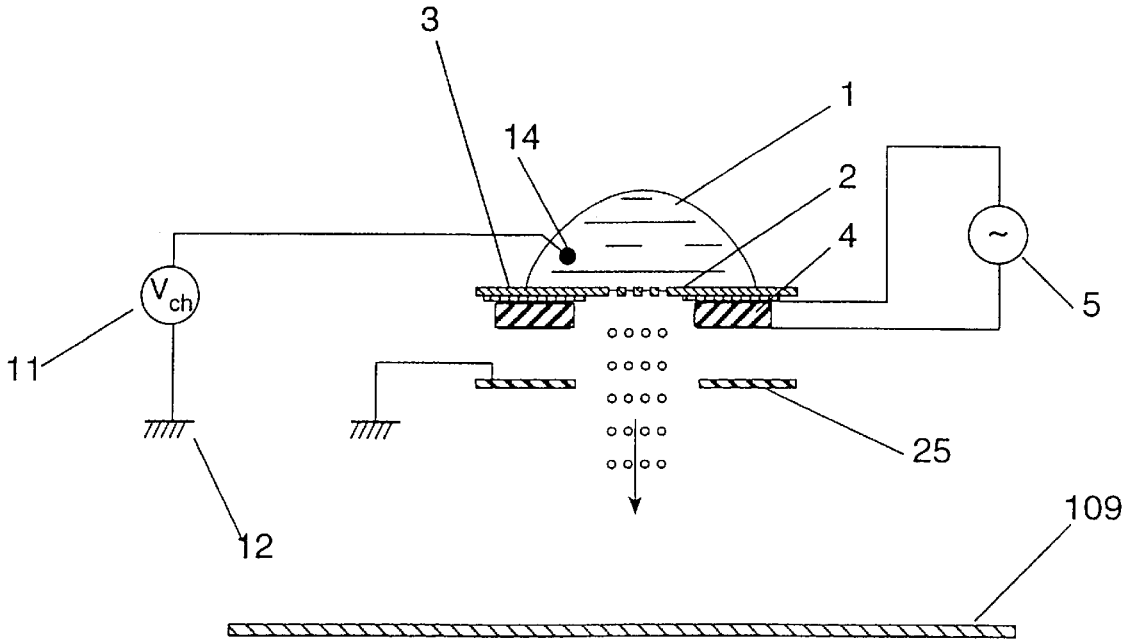
Figure 5:
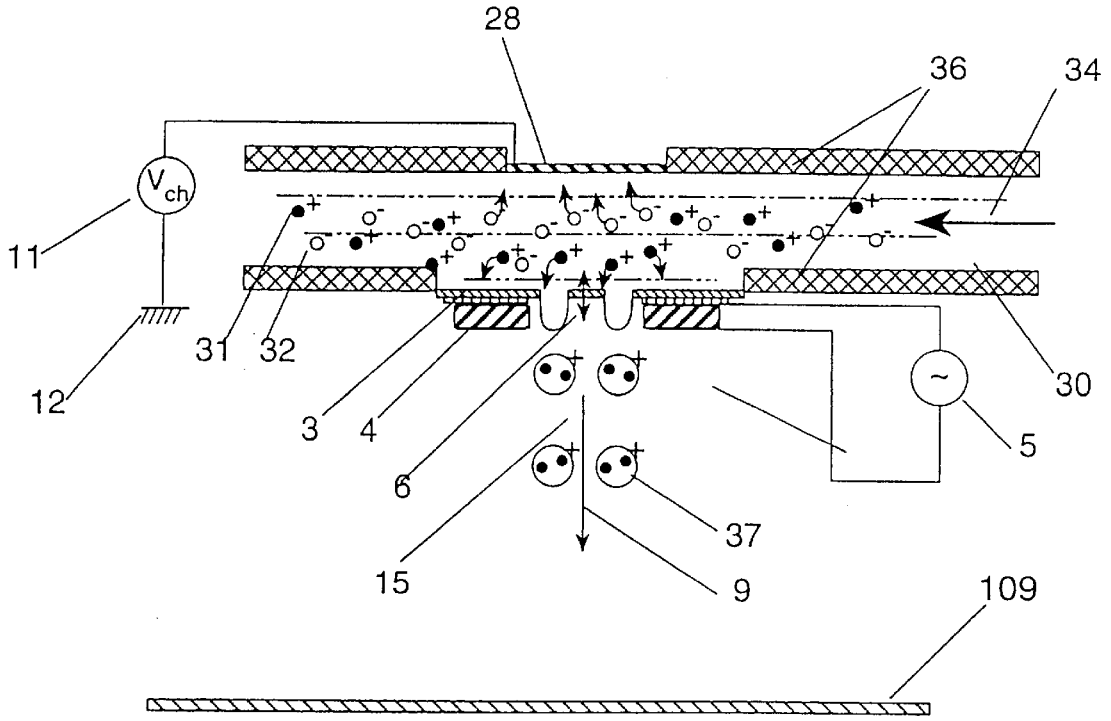
Figure 6:
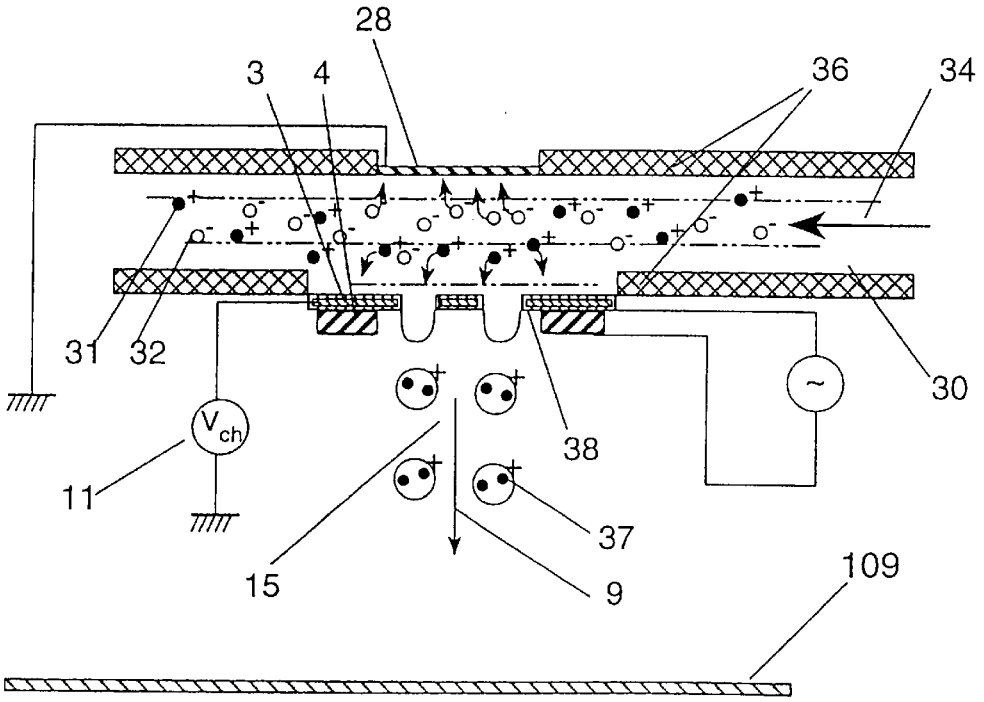
Figure 7:
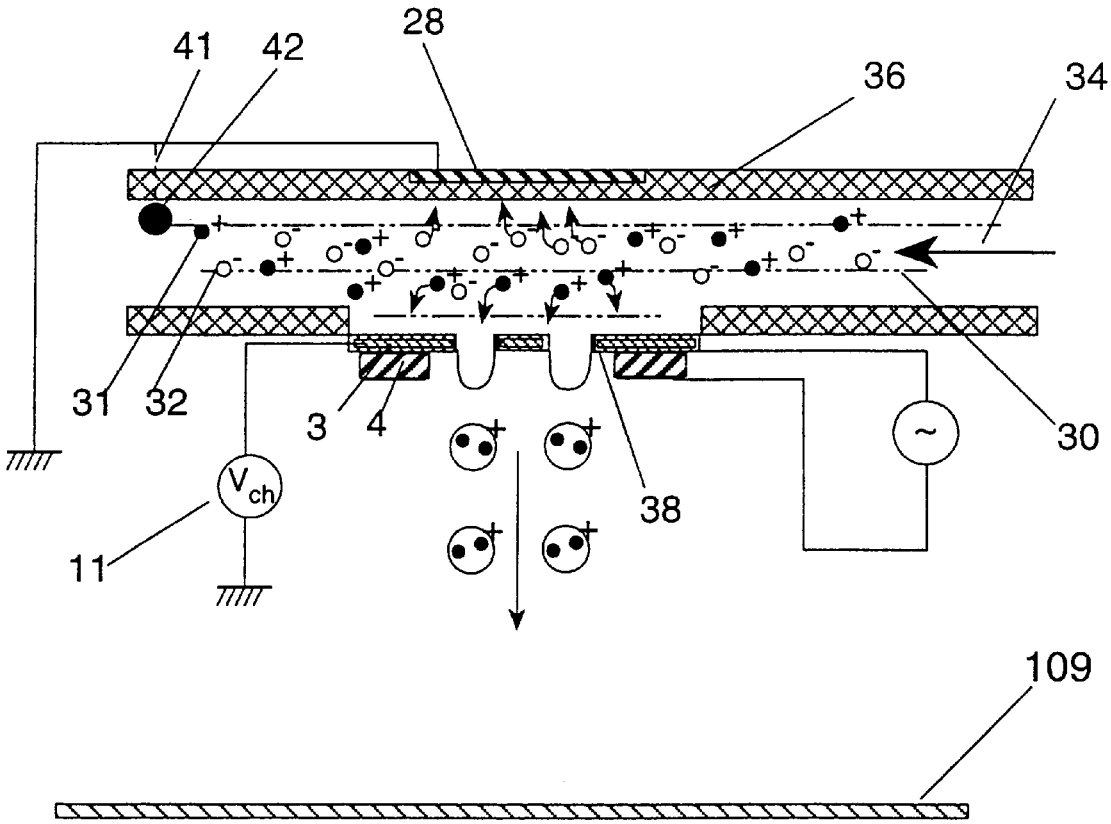
Figure 8:
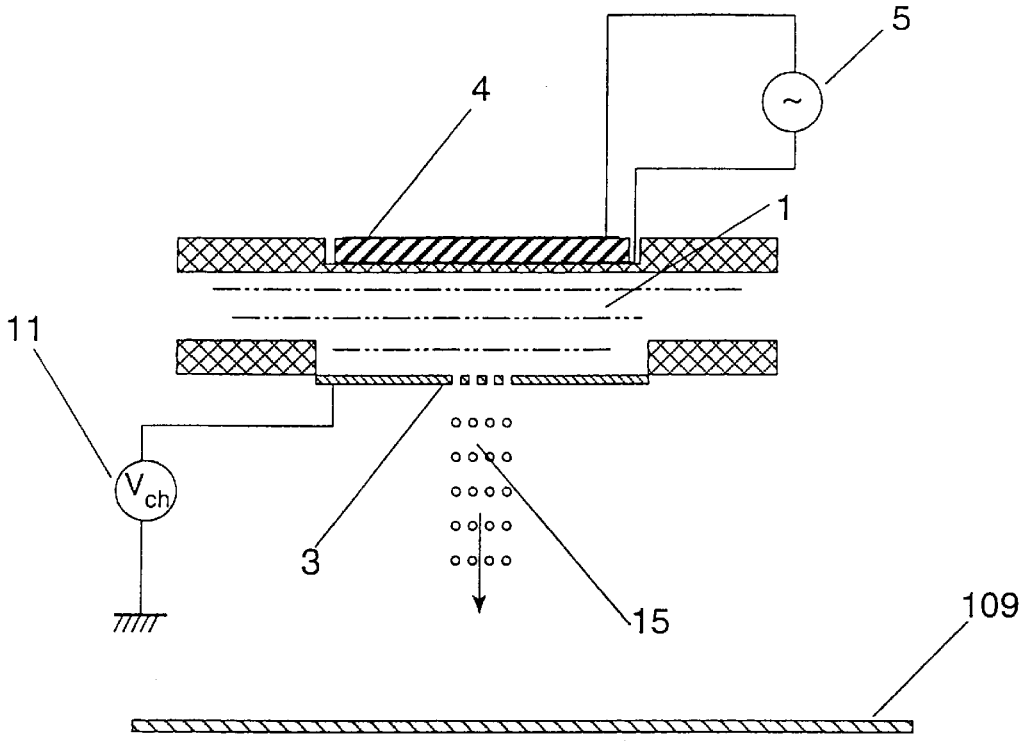
Figure 9:
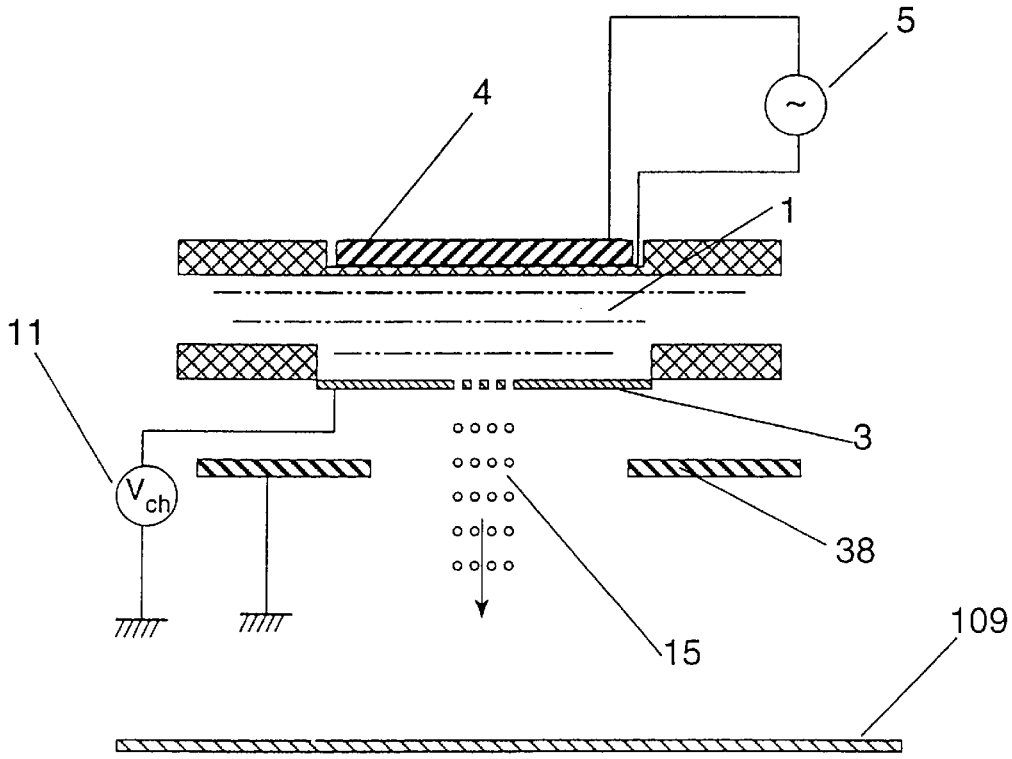
Figure 10:
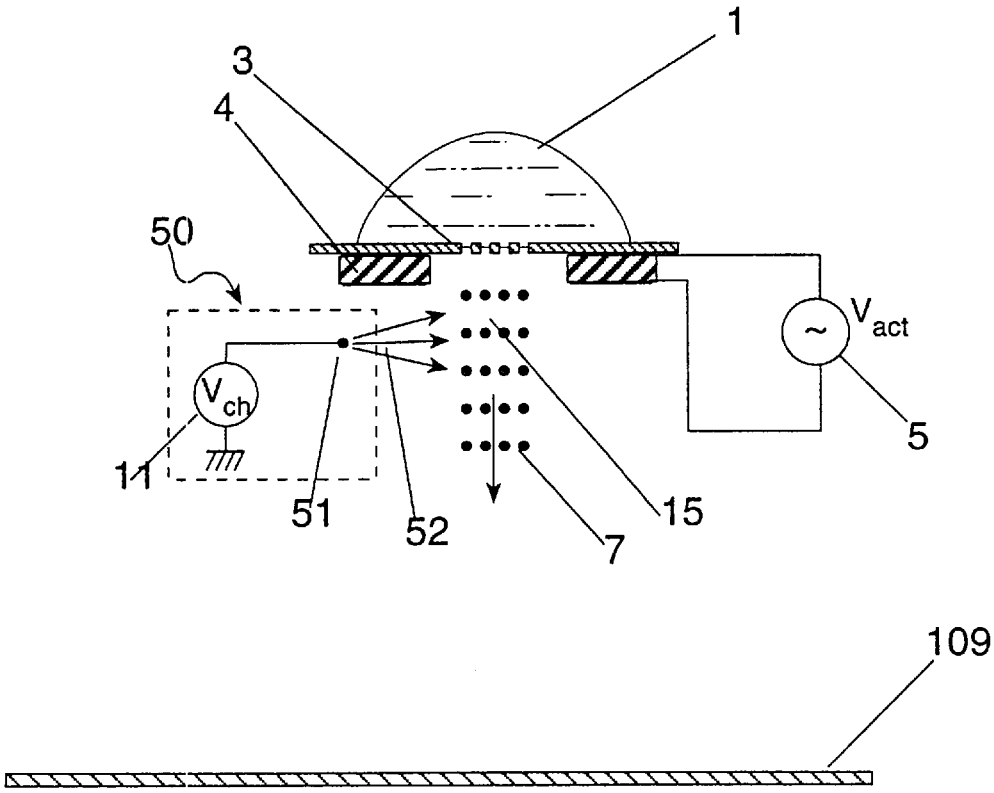
Figure 11:
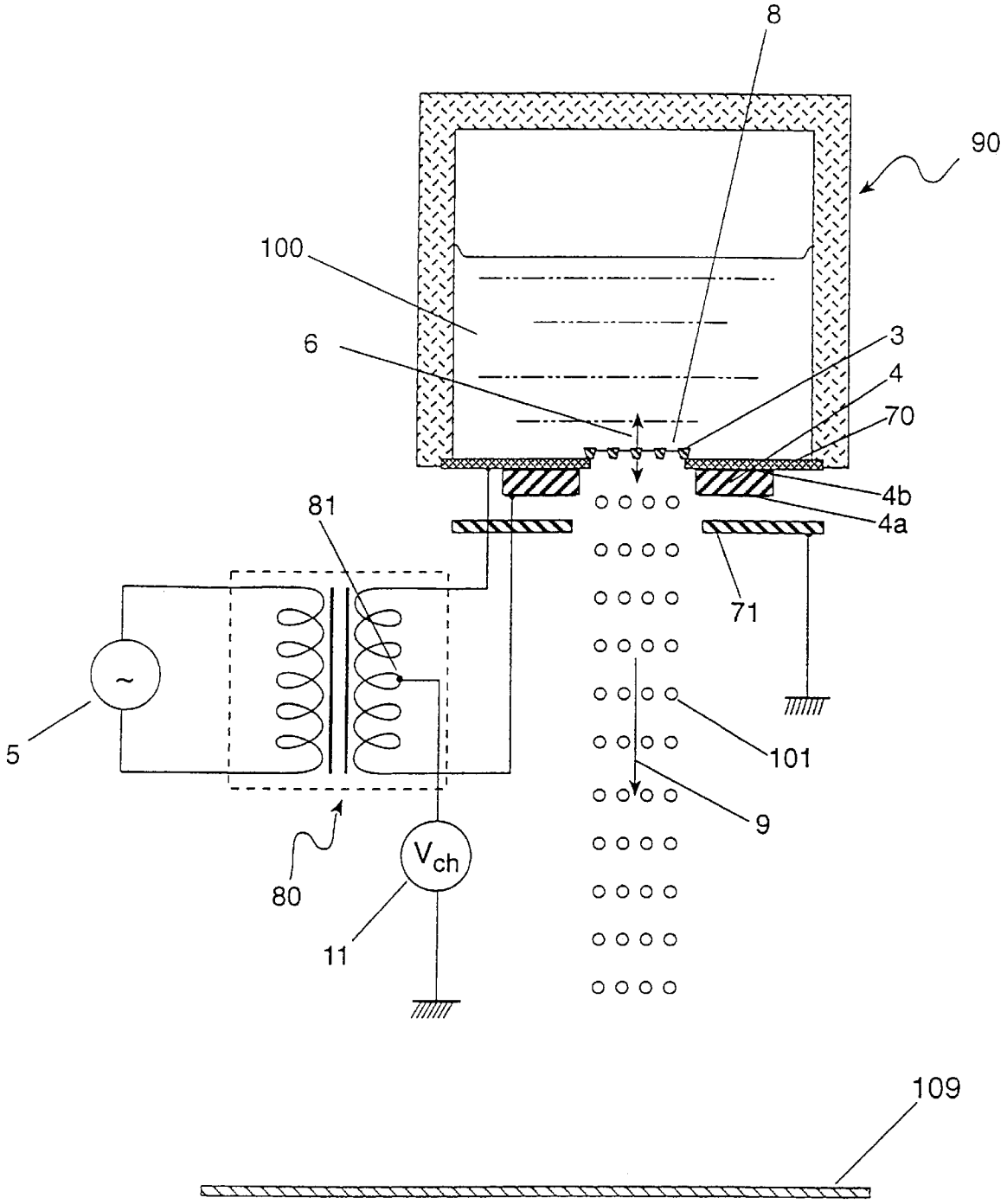
Figure 12:
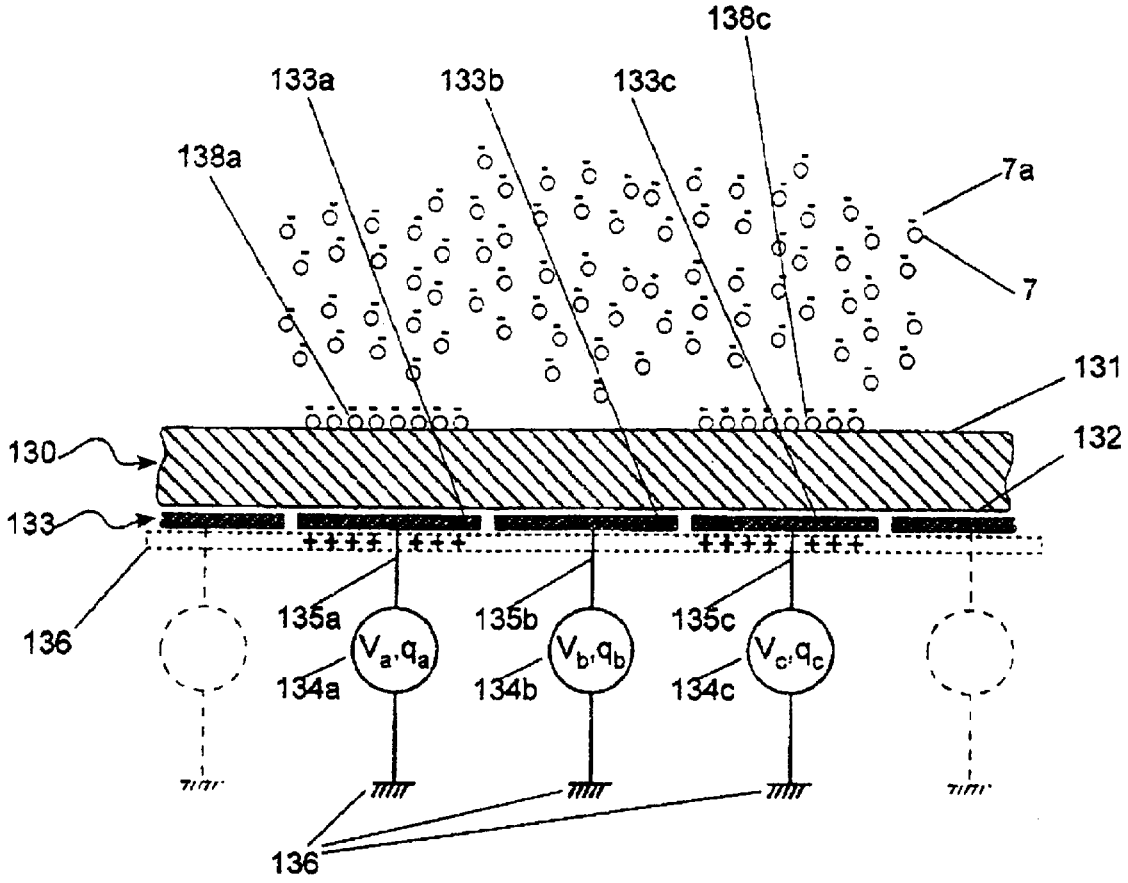

FIG. 3: is a sectional view of a droplet dispensation and charging apparatus with an induction electrode FIG. 4: is a sectional view of a second droplet dispensation and charging apparatus with an induction electrode FIG. 5: is a schematic section of a droplet dispensation and charging apparatus suitable for use with liquids carrying charge species but that are otherwise are non-conducting FIG. 6: is a schematic section of a second droplet dispensation and charging apparatus suitable for use with liquids carrying charge species but that otherwise are non-conducting FIG. 7: is a schematic section of a third droplet dispensation and charging apparatus suitable for use with liquids carrying charge species but that are otherwise non-conducting FIG. 8: is a schematic section of a droplet dispensation and charging apparatus in which droplet production occurs as a result of vibrations induced within the liquid FIG. 9: is a schematic section of a second droplet dispensation and charging apparatus in which droplet production occurs as a result of vibrations induced within the liquid FIG. 10: is a schematic section of a droplet dispensation apparatus in which droplet charging occurs after droplet dispensation FIG. 11: is a schematic section of a further embodiment of an apparatus according to the invention FIG. 12: shows a further example of a means for providing electrical charge or potential to the substrate shown in the above figures.

FIGS. 1*a* to 1*c*,2*a*,3 and 4 show embodiments suitable for conductive supply of free charge to conducting liquid. FIGS. 5 to 8 show embodiments in which the supply of liquid itself supplies further charge as charged droplets are ejected. In the cases of FIGS. 1 to 8 is shown droplet production by the action of a vibrating perforate plate or membrane. FIGS. 9 to 10 show similar embodiments to selected forms from FIGS. 1 to 8 but in which droplet production is effected by inducing vibration directly within the liquid rather than inducing vibration of the perforate plate or membrane in order, in turn, to induce vibration of the liquid.

FIG. 1*a* shows a first embodiment having a generally circular geometry. In this example, conducting liquid shown at 1 is brought into contact with at least the perforate region of the rear face 2 of a perforate plate or membrane 3 by a supply means 16 (shown schematically as a syringe body) and in which a circular piezoelectric vibration actuator 4, under the influence of an alternating electrical power source 5 (supplying an alternating potential $V_{act}$) causes the plate or membrane 3 to vibrate in the direction shown by arrow 6. The vibration results in liquid being ejected from perforations 8 in the plate or membrane and for that ejection to be in the form of droplets 7 in the direction shown by arrow 9 generally towards a substrate 109 Although FIG. 1*a* shows the droplets being ejected substantially normal to the surface of the substrate 109, the ejection may be arranged to be substantially parallel to the substrate surface. In use, the electrostatic field presented by charge or potential on or below the surface of the substrate 109 (as further described below) still ultimately directs the motion of the droplets towards the surface of the substrate.

The vibration provided by the actuator 4 is coupled directly to plate or membrane 3, but may alternatively be coupled to the plate or membrane via an intermediate coupling element. The actuator 4 is preferably chosen to operate in the frequency range above 10 kHz. If very small droplets, for example 10 $\mu$m or smaller diameter, are to be produced the actuator 4 may typically be operated in the range 200 kHz to 5 MHz.

A means 10 to supply free electrical charge to liquid 1 comprises an electrical supply 11 capable to supply free charge at a potential $V_{ch}$ relative to ground potential (shown at 12) via conductors 13 to an electrode of a 'charge donating assembly' 14 immersed in the liquid. Charge may thence flow to any other conductors in electrical contact with the liquid and so be donated to droplets emergent from the apparatus. For this reason the assembly of electrical conductors, including the electrode shown in the figure, in electrical contact with liquid 1 is referred to as the 'charge donating assembly'. Control of $V_{ch}$ to differ from the electrical potential of the airspace 15 a short distance in front of plate or membrane 3 causes the droplets to emerge with an electrical charge, the sign and magnitude of which is responsive to variation of $V_{ch}$. It is to be noted that the electrical potential of airspace 15 is in general influenced by the free charge density present in that airspace introduced by the charged ejected droplets 7.

In the embodiment of FIG. 1 all materials other than the free electrical charge supply means 10 contacting liquid 1; including perforate plate or membrane 3, any intermediate vibration coupling means between plate or membrane 3 and actuator 4 (not shown), and any enclosure for liquid 1 (not shown) may be electrical insulating.

FIG. 1*b* shows a plan view of the piezoelectric actuator 4 and the perforate plate or membrane 3 shown in FIG. 1*a*. There is shown an electrode 4*a* on the upper surface of the acuator. There will, for actuators of this annular circular form, be a similar electrode on the under surface of actuator 4. (That second electrode is typically a separate element from plate or membrane 3, and may be electrically insulated from it.)

FIG. 1*c* shows, in enlarged cross-sectional form, droplets 7 of liquid 1 emergent from perforations or orifices 8 in the plate or membrane 3 showing that the orifices locate, at 17, the menisci of the liquid emerging from the plate or membrane 3 (in this case they circumscribe the menisci at the front of the plate or membrane 3). The separation of the orifices may be controlled to limit in-flight coalescence of droplets so ejected. Other surface features of member 3, including surface relief features of unperforated membranes or plates, may also provide this desired meniscus location effect.

In the understanding of the inventors, free charge flows into the liquid and electrode (and other elements of the charge donating assembly 14) because there is both a finite electrical capacitance between the charge donating assembly and its surroundings and a difference of electrical potential with those surroundings. (The "surroundings" may, for these electrostatic purposes, be considered to be at an infinite distance from the charge donating assembly. The capacitance is influenced by the geometry of the charge donating assembly). Correspondingly there is a discontinuity in the component of the electrical displacement D normal to the meniscus surface and a corresponding free surface charge density s (both as known in the electrostatic arts) across the menisci of the liquid emerging from the perforations. Consequently, as droplets break off from the emerging menisci they carry away some charge. As liquid is lost from the assembly as droplets, the provision of a continuing supply of free charge (in this example supplied by electrical supply means 10) allows further electrical free charge to flow into the liquid to replenish that carried away by the ejected droplets.

FIG. 1*d* shows one means of providing a uniform area of electrical charge 123 on the substrate 109 and alternatively or additionally providing a pattern of electrical charge 124. In the example shown, the substrate 109 comprises a photoconductive material layer 110 having, on its lower surface, a conductive electrode layer 112. The photoconductive material layer 110, prior to receiving charge, is generally allowed to attain a 'dark-adapted' state, as is well known in the electrophotographic arts. The conductive electrode layer 112 is, in this example, held at ground potential (shown at 113) by a conductor 114.

A corotron ion source 115, comprising a fine wire 116 (elongate in the direction normal to the figure) raised to a potential $V_w$ by an electrical supply 117, and optional conducting grid elements 118 and screen elements 119 may also be provided. The potential $V_w$ is chosen to be sufficiently large that the electrical field in the immediate vicinity of wire 116 is sufficiently large to cause ionisation of the air and thereby to produce a stream of ions that are directed, at least in part and as shown at 120, towards the surface 121 of the substrate 109.

By applying suitable electrical potentials (not shown) to the grid and screen elements 118 and 119, improved control over the stream of ions shown at 120, and thereby over the deposition of those ions on to the surface 121, may be obtained, as is well known in the electrographic arts. In a typical embodiment, the substrate 109 may be moved in the direction shown at 122 and a uniform deposition of charge shown at 123 over an area of surface 121 passing underneath corotron 115 may thereby be provided.

To form a pattern in the deposited charge, photoconductive material 110 may, after receiving charge as described above, be illuminated with a pattern of illumination causing, through the photo-induced conductivity of layer 110, discharge in regions 124*a* where layer 110 is illuminated but no discharge in regions 124*b*, where layer 110 is not illuminated. The source of the pattern of illumination may, for example, be a scanning and temporally-modulated illumination source. One such source is shown schematically at 125 as a scanning laser source that provides illumination beam 126 that traverses the surface of substrate 109 in a direction normal to the figure.

The apparatus of FIG. 1*d* is found suitable for use in conjunction with the apparatus as described with reference to FIGS. 1*a* to 1*c* above (and also further with reference to alternative embodiments as described below) to effect deposition of charged droplets 7 on the surface of the substrate 109 according to the pattern of charge represented at 124*a* and 124*b*. Deposition of charged droplets 7 upon surfaces of insulating materials is similarly found to be effected according to patterns of electrical charge or potential formed below such surfaces.

Further, deposition of charged droplets 7 upon surfaces on conducting materials is also found to be effected according to the electrical charge or potential of such materials.

In the example of FIG. 2, the plate or membrane 3 forms part of the charge donating assembly 14 (and is therefore necessarily electrically conducting) and thus the electrode of FIG. 1*a* may be eliminated, and the plate or membrane 3 receives free charge from the source 11 by contact 18 and via conductor 13. Plate or membrane 3 therefore donates free charge to the liquid 1. In this case, if the alternating power source 5 is not electrically isolated from ground, then it may be desirable to insulate electrically (but not mechanically) the plate or membrane 3 from the actuator 4 and hence provide electrical insulation from the power source 5. In the example given of a piezoelectric actuator this may be achieved by interposing a thin, mechanically stiff, electrically insulating layer 19 between actuator 4 and plate or membrane 3. Alternatively or additionally, the alternating power source 5 may be electrically isolated from ground potential by an isolating transformer 20 as shown in FIG. 2*b*.

In the example of FIG. 3 is shown an induction electrode 25, in front of the perforate plate or membrane 3 whose potential or electrical charge level is maintained by the electrical supply 11 via conductors 21. In this case free charge is supplied at ground potential to the liquid 1 (as shown) via electrode responsive to the potential or charge upon the induction electrode 25. Again the electrode of the charge donating assembly 14 may be replaced by an electrical connection 18 to a conducting plate or membrane 3 (not shown). Similarly electrical, though not mechanical, isolation of the plate or membrane 3 from the power source 5 can again be selected as appropriate and as discussed with respect to FIG. 1.

The inventors understand that, in relation to the example of FIG. 3, the induction electrode 25 allows the capacitance between the 'charge donating assembly' and its surroundings (and specifically to induction electrode 25) to be increased and that, for a given difference in potential between the liquid and the airspace 15, this allows the discontinuity in electrical displacement D at the menisci as described above to be increased, thereby allowing the droplets to carry away a greater charge. Alternatively, for a given charge on the droplets the potential difference and therefore typically the magnitude of $V_{ch}$, may be reduced; allowing a simpler or less expensive electrical supply 11.

In FIG. 4 is disclosed an alternative electrical arrangement in which free charge is supplied to the liquid 1 at potential $V_{ch}$ by the electrical supply 11, and an induction electrode 25 is connected to electrical ground potential. This implementation has the advantage, over that of FIG. 3, of improved electrical safety for apparatus in which the 'charge donating assembly' is inaccessible but where the induction electrode 25 is accessible to users of the apparatus.

With reference to all geometries in which there are multiple orifices such that some droplets are ejected in between other droplets from more 'central' orifices and the induction electrode it is to be noted that satisfactory charging of droplets is surprising and is in marked distinction to the situation for CIJ induction charging. With particular reference to the circular geometry of FIGS. 3 and 4, charging of those droplets at 26 lying towards the centre of the emitted droplet stream is surprising and is in distinction to the situation for CIJ induction charging, for which one induction electrode is provided for each emitting orifice. In the present case of a single induction electrode and multiple emitting perforations, the droplets at 26 towards the centre of the stream are surrounded by other charged droplets at 27 towards the outside of the stream. These latter are understood partially electrically to 'screen' the more central droplets from the influence of the induction electrode 25, thereby reducing the discontinuity in electrical displacement D and hence the surface charge density upon the meniscus of the emerging liquid droplets at the centre of the stream. However, with the present apparatus this is found not to be limiting. It is believed that this is because inhomogeneous distributions of charge create electrostatic pressure gradients acting in the direction to reduce the inhomogeneity and so produce an overall electrically well-behaved droplet stream. Analogous effects are also believed to occur with reference to the charging geometries of FIGS. 1 and 2.

In each of the circular-geometry forms shown in FIGS. 2–4 above, with appropriate detailed embodiments, it is found that the simultaneous ejection of multiple droplets creates a cooperative droplet transport effect that enables droplets to be charged by and yet predominantly to be transported past, induction electrode 25. The electrostatic mutual repulsion between droplets and air entrainment only subsequently causes substantial slowdown and spreading of the droplet stream. The result, in the particular case of the preferred embodiment also further described with reference to FIG. 11, is a rather dense cloud of near-stationary droplets some few centimeters away from the apparatus that is suitable for deposition on substrates according to a pattern of electrical charge or potential upon or below the surface of those substrates.

The same cooperative transport effect is also observed with geometries in which the orifices are arranged in an pattern that is much longer in one direction than another. Linear geometries (where the orifices extend much further in one direction than they do in a perpendicular direction) indeed, have particular advantage for deposition of liquids and/or solids upon substrates moving relative to the apparatus; when, by arranging the long dimension of orifices to lie tranverse to the relative motion between apparatus and substrate, high uniformity of deposition (according to the pattern of charge upon or below the substrate surface) can be produced.

In FIGS. 5 to 7 is shown apparatus suitable for use with a liquid 30 that incorporates species 31 that have a net positive electrical charge and species 32 that have a net negative electrical charge. The liquid 30 is brought to the vicinity of auxiliary electrode 28 and the rear face of perforate plate or membrane 3 via an insulating supply duct 36. The liquid 30 may, for example, be a liquid comprising an insulating carrier in which charged species 31 are mobile toner particles and charged species 32 are mobile counter-ions. We use this example for the embodiments shown in FIGS. 5 to 7 to illustrate the case where it is desirable to eject positively-charged droplets carrying toner particles, although other examples will be apparent to the person skilled in the art.

In FIG. 5 is shown an auxiliary electrode 28 in direct contact with liquid 30 and which is capable of receiving free electrical charge from electrical supply 11 at a potential $V_{ch}$, which in this example is taken to be a positive potential with respect to the potential of airspace 15 a short distance in front of plate or membrane 3. Perforate plate or membrane 3, which may be formed either of conducting or of non-conducting material, is vibrated in the direction shown at 6 causing charged droplets 37 to be ejected into airspace 15 in the direction shown at 9. Replenishing supply of liquid 30 is provided by insulating duct 36 in supply direction shown at 34 as liquid is lost from the plate or membrane perforations. As liquid 30 approaches the neighbourhood of auxiliary electrode 28, species 32 are initially attracted towards and toner particle species 31 are repelled away from that electrode. Consequently, in the region immediately adjacent auxiliary electrode 28 liquid 30 acquires a net negative space charge from the raised concentration of counter-ions 32. Either by a low amount of counter-ion species 32 ( and of toner particles 31), or by the supply of free charge by auxiliary electrode 28 to counter-ion species 32, the space charge build-up in this region is limited and toner particles 31 experience repulsion from auxiliary electrode 28 towards perforate plate or membrane 3. Therefore, ejected droplets 37 are formed with a net positive charge and with a raised concentration of toner particles. This geometry is also suitable for use with aqueous solutions, including water itself, in which case electrode 28 acts similarly to electrode of the charge donating assembly 14 of FIG. 1*a*.

In FIG. 6 is shown an alternative arrangement to that of FIG. 5 in which perforate plate or membrane 3 is conducting and raised to potential $V_{ch}$, taken by way of example to be a negative potential with respect to the potential of airspace 15, by electrical supply 11 and in which it is electrically insulated from liquid 30 by a thin dielectric layer 38. In this example, auxiliary electrode 28 in contact with liquid 30 is capable of receiving free electrical charge at ground potential. Positive space charge density arises in the region immediately behind perforate plate or membrane 3 due to the electrostatic attraction of toner particles 31 towards perforate plate or membrane 3. Again, on ejection of liquid as droplets from perforate plate or membrane 3, droplets 37 are formed with a net positive charge and with a raised concentration of toner particles. This geometry also operates with aqueous solutions and water, it is believed due to the effect of electrical fringing fields within the perforate regions of perforate plate or membrane 3.

FIG. 7 shows similar apparatus but in which auxiliary electrode 28 is electrically insulated from the liquid so that it cannot supply free charge to counter-ion species 32. In consequence, unless the total amount of counter-ion species 32 or toner particles sufficiently limited, the space charge adjacent to auxiliary electrode 28 and membrane 3 may increase to such an extent that the resultant electrical field within the liquid between auxiliary electrode 28 and perforate plate or membrane 3 prevents further migration of toner particles 32 towards perforate plate or membrane 3. The inventors understand that this need not prevent ejection of charged, toner-rich droplets provided the supply of liquid 30 along duct 36 and past perforate plate or membrane 3 and auxiliary electrode 28 sweeps away at least part of the space charge region of counter-ions adjacent auxiliary electrode 28. If a closed or recirculating liquid supply system is desired, however, a 'downstream' electrode capable to supply free charge to the liquid as shown by dashed conductor 41 and electrode 42 in FIG. 7 allows indefinite operation of the apparatus. In this case this embodiment is also suitable for operation with aqueous solutions and water.

It is not required that droplet production is effected by action of actuator 4 to vibrate perforate plate or membrane 3 or other incorporating in use orifices contacted by liquid and circumscribing their menisci. Alternatively actuator 4 may induce vibrations (generally ultrasonic vibrations) within the liquid contacting the plate or membrane 3, which may now advantageously be mechanically rigid. An embodiment similar to that of FIG. 2 but in which actuator 4 induces such vibration within the liquid is shown in FIG. 8. A further embodiment in which an induction electrode 38 is employed is shown in FIG. 9.

Further embodiments similar to that of FIG. 5 and suitable for use with non-conducting liquids carrying charged species components will be evident to the reader skilled in the art.

It is not required that the ejected droplets are ejected already carrying an electrical charge. The charge can be imposed on droplets following their generation by perforate plate or membrane droplet generation apparatus of the types disclosed above. An example is shown in FIG. 10.

In FIG. 10 is shown droplet generating apparatus, which generally may be of any of the types disclosed above, used in conjunction with a corotron ion source 50. The corotron ion source comprises a fine wire 51 raised to a potential $V_{ch}$ by electrical supply 11, at which potential the electrical field in the air or other gas in the immediate vicinity of wire 51 is sufficiently large to cause ionisation of the air (or other gas) to produce a stream of ions 52 that may be directed towards the droplets 7. Impact of such ions with the droplets gives them a free electrical charge. Known refinements of the corotron that may be used to advantage in this application include those as already described with reference, FIG. 1*d,* to the use of corotron charging of the substrate 109, of a ground electrode (not shown) on the side of the wire 50 furthest from droplets 7 and the provision of a so-called "grid electrode", known in the electrographic arts, on the side of the wire 50 nearest the droplets 7.

The best embodiment of the invention presently known to the inventors comprises the general arrangement of FIG. 4 used in conjunction with the preferred embodiment of droplet dispensation apparatus substantially as described in co-pending application WO-A-95/15822 together with pressure control of the liquid.

The detailed implementation used is as shown in FIG. 11. In one experiment with this arrangement tap water 100, whose conductivity exceeded 1 $\mu$S/m, was placed in a closed and insulated reservoir 90. To the base of the reservoir, a perforate membrane droplet device of the type described in co-pending application WO-A-95/15822 was attached in such a way as to form a direct electrical contact between the perforate membrane 3 and the water, via a simple gravity feed.

Piezo-ceramic actuator 4 was electrically and mechanically coupled to a metallic substrate 70, in turn electrically and mechanically coupled to perforate membrane 3. No insulating layer 19 between the piezo-ceramic element 4 and the substrate 70 was employed; instead the charging potential $V_{ch}$ was applied by supply 11 directly to the substrate 70 (and so to one electrode of the piezoelectric actuator 4 and the perforate membrane 3) via a center tap 81 on the secondary windings of the isolation transformer 80. This potential was varied between ±0 kV and ±1.8 kV. The primary of isolation transformer 80 was connected to alternating voltage supply 5, providing a sinusoidal voltage of 70 volts peak to peak at the actuator 4 at frequency in the region of 280 kHz.

Perforate membrane 3 was 50 $\mu$m thick and formed of electroformed nickel; it included perforations 8 whose smallest diameter was 30 $\mu$m. These perforations were arranged on a triangular 200 $\mu$m pitch and were tapered perforations in such a way that the hole taper opens outwards into the air. This perforate membrane, with an overall diameter of 6 mm, was bonded onto a 4 mm center diameter hole in a 300 $\mu$m thick stainless steel substrate 70 whose outer diameter was 20 mm. Onto the front face of this assembly, a 200 $\mu$m thick piezoelectric ceramic annular actuator 4, having continuous silver electrodes 4*a* and 4*b* fired onto and extending over its major faces, was electrically and mechanically attached. The outer diameter of annular actuator 4 was 14 mm and the inner diameter was 9 mm. It was of a type known as P51 from Hoechst Ceramtec.

A negative pressure, near to the pressure at which air entered the closed reservoir 90 through perforations 8 was applied to the water 100 within the reservoir. The induced vibration shown at 6 in the mesh, resulted in ejection of droplets 101 of water in direction 9 at an average flow-rate of 3.4 $\mu$l/s. The volumetric mean diameter of the droplets was measured to be 10.1 $\mu$m using a commercially-available Malvern Mastersizer S instrument.

An earthed induction electrode structure 71, having a central hole of diameter 8 mm was positioned a distance of 4 mm in the front of the membrane 3, through which the water droplets 101 were ejected. This geometry was modelled using electrostatic modelling software to create at the surface of the perforate membrane a spread of 20% from the mean value electric field between induction electrode 71 and substrate 70 and membrane 3.

Charge was found to be imparted to the droplets. The ratio of droplet charge to droplet mass (Q/M) was measured by directing the droplet stream into a collection pot made of conducting material placed upon a mass balance (not shown). An electrometer was connected between the conducting pot and electrical earth to measure the total charge of collected droplets, and the mass balance measured the total mass of the same droplets. The charge to mass ratio Q/M was thereby determined and was found to be approximately proportional to the potential $V_{ch}$ provided by supply 11 with proportionality constant of $3\times10^{-6}$ coulombs per kilogramme per volt.

This apparatus and closely-similar conditions were also employed using an aqueous suspension of pigment particles at a solids volume concentration of 5%. When the produced droplet spray was brought in the near proximity of the imagewise charged photoconductive substrate presented by a Hewlett-Packard® LaserJet 4 printer producing charge patterns with high spatial resolution, the droplet stream deposited faithfully upon the charged regions of the substrate and with little or no deposition on uncharged regions.

The best embodiments of the charging means used with the second aspect of the invention are standard forms of corotron used to deposit charge upon a photoconductor surface, as generally described for example in Schaffert's book *'Electrophotography'* published by Focal Press.

The apparatus therefore advantageously allows delivery of charged droplets of aqueous toners in a manner suitable for imagewise development of charge patterns upon or below separate substrates to produce high contrast image marks.

FIG. 12 shows a further example of a means for providing a pattern of electrical charge or potential (shown at 136) below the surface 131 of a substrate 130 in a manner suitable for charged droplets 7 to deposit upon that surface responsive to that charge pattern.

Substrate 130 in this case comprises a thin insulating layer of material, typically of thickness in the range 5 to 100 microns, with an upper face 131 exposed to droplets 7 having charge 7*a* (shown by way of example as a negative charge) produced by any of the embodiments of charged droplet production apparatus referred to above. In close proximity to a lower face 132 of the substrate 130 is placed an assembly of electrodes 133, partially shown in the figures as 133*a*, 133*b*, and 133*c*. To each electrode 133*a*, 133*b*, 133*c* . . . is respectively applied potentials $V_a$, $V_b$, $V_c$ (by way of example above ground potential) shown at 136 by electrical supplies 134*a*, 134*b*, 134*c* . . . via conductors 135*a*, 135*b*, 135*c* . . . . Alternatively electrical supplies 134*a*, 134*b*, 134*c* . . . may instead be operated to supply to electrodes 133*a*, 133*b* and 133*c* fixed electrical charges $q_a$, $q_b$, $q_c$.

The electrostatic field pattern produced by the potentials $V_a$, $V_b$, $V_c$ . . . or charges $q_a$, $q_b$, $q_c$ . . . located below the surface 131 of the insulating substrate 130 ('below' being used in the sense of being on the face of substrate 130 more remote from the droplets 7) extends above the upper surface 131 ('upper' being used in the sense of being on the face of substrate 130 less remote from the droplets 7) and charged droplets 7 deposit on to the surface 131 responsively to those potentials or charges. By way of example only the sign shown at 7*a* of the charge of droplets 7 is shown to be opposite to the sign of the potential or charge provided below the substrate surface shown at 136. In this way droplets 7 are attracted electrostatically to deposit preferentially upon the more highly charged or higher potential (as appropriate) of electrodes 133, as shown at 138*a* and 138*c*.

When the electrodes 133 are maintained at a constant electrical potential, electrical charge in general flows into or out of those electrodes as droplets 7 approach and deposit on to the surface 131. Typical values for such potential lies in the range 100 to 1000 volts. When, alternatively, the electrodes 133 are supplied by electrical supplies 134*a*, 134*b*, 134*c* . . . with fixed amounts of charge $q_a$, $q_b$, $q_c$ . . . the electrical potential of those electrodes changes as the droplets 7 approach and deposit on to the surface 131. (These effects occur also where the electrical pattern is formed upon as well as below the surface 131 of the substrate 130).

What is claimed is:

1. A method of supplying material to a substrate, said method comprising:

supplying liquid to a member having a surface, said surface having a plurality of features locating menisci of said liquid at said surface;

inducing mechanical vibrations within the liquid located by said features, thereby forming liquid droplets and causing said liquid droplets to be sprayed from said member;

supplying electrical charge to the liquid before or as said droplets are sprayed from said member; and providing electrical charge or potential to the substrate, whereby said droplets are directed towards said substrate to deposit said material thereon.

2. A method according to claim 1, wherein said spray is directed substantially parallel to said substrate.

3. A method according to claim 2, wherein said electrical charge is supplied conductively to the liquid through said member.

4. A method according to claim 1, wherein said liquid is supplied to said member at or below ambient pressure.

5. A method according to claim 4, wherein said electrical charge is supplied to the liquid droplets after they are sprayed from said member.

6. A method according to claim 5, further comprising inducing charge on said droplets by means of an induction electrode disposed on the side of said member adjacent to said surface.

7. A method according to claim 1, wherein said electrical charge is supplied conductively to the liquid at one side of said member opposite to said surface.

8. A method according to claim 7, further comprising inducing charge on said droplets by means of an induction electrode disposed on the side of said member adjacent to said surface.

9. A method according to claim 1, wherein electrical charge or potential is supplied to the surface of said substrate.

10. A method according to claim 1, wherein electrical charge or potential is supplied to the substrate on the side of said substrate remote from said member.

11. A method according to claim 1, wherein electrical charge or potential is supplied to the substrate on the side of said substrate adjacent to said member.

12. A method according to claim 1, wherein said providing electrical charge or potential is supplied to the substrate by means of a corotron ion source.

13. A method according to claim 1, wherein the spacing between said droplets in a direction transverse to their path, their size and their speed is adapted to cause said droplets to entrain air during their flight, thereby to form a moving body of fluid.

14. A method of providing an image on a substrate, the method comprising forming said image from a material species carried by liquid droplets, wherein said material species is supplied to said substrate by a method according to claim 1.

15. A method according to claim 14, wherein said species are disolved or suspended in said liquid.

16. A method according to claim 15, wherein said liquid is formed, at least in part, of water.

17. A method according to claim 15, wherein said species are charged particles or ions.

18. Apparatus for depositing material supplied in the form of a liquid on to a substrate comprising:

a member having a surface for receiving the liquid, a plurality of features at said surface for locating thereat menisci of the liquid supplied to said member;

an actuator for inducing mechanical vibrations within the liquid located by said features to cause liquid droplets to be formed and sprayed from said member;

liquid supply means for supplying liquid to the member;

means for supplying electrical charge to the liquid before or as said droplets are sprayed from said member; and means for providing electrical charge or potential to the substrate, whereby said droplets are directed towards said substrate to deposit said material thereon.

19. Apparatus according to claim 18, wherein said member comprises a plate.

20. Apparatus according to claim 18, wherein said member comprises a flexible membrane.

21. Apparatus according to claim 18, wherein said surface is a planar surface.

22. Apparatus according to claim 18, wherein said features comprise orifices through said member.

23. Apparatus according to claim 18, wherein said actuator comprises a piezoelectric transducer connected to said member to cause said member to vibrate in use, thereby to vibrate said liquid to produce said droplets.

24. Apparatus according to claim 18, wherein said actuator comprises a piezoelectric transducer disposed to vibrate said liquid directly to produce said droplets.

25. Apparatus according to claim 18, wherein said liquid supply means supplies liquid at or below ambient pressure.

26. Apparatus according to claim 18, wherein said means for supplying electrical charge to the liquid comprises at least one electrode disposed to one side of said member opposite to said surface and arranged to contact said liquid supplied thereto whereby said charge is applied conductively through the liquid.

27. Apparatus according to claim 26, further comprising an induction electrode disposed on the side of said member adjacent to said surface to induce charge on said droplets.

28. Apparatus according to claim 18, wherein said means for supplying electrical charge to the liquid comprises at least one electrode disposed on said member whereby said charge is applied conductively through the liquid.

29. Apparatus according to claim 18, wherein said means for supplying electrical charge to the liquid comprises means arranged to apply charge to said droplets after they are sprayed from said member.

30. Apparatus according to claim 29, wherein said means for supplying electrical charge to the liquid comprises a charge emitting electrode disposed on the side of said member adjacent to said surface to induce charge on said droplets.

31. Apparatus according to claim 29, wherein said means for supplying electrical charge to the liquid comprises a corotron ion source.

32. Apparatus according to claim 29, wherein said means for supplying electrical charge to the liquid comprises an electrogasdynamic ion generator.

33. Apparatus according to claim 18, further comprising an auxiliary electrode disposed to one side of said member opposite to said surface.

34. Apparatus according to claim 33, wherein said auxiliary electrode has an insulated layer to insulate it from said liquid.

35. Apparatus according to claim 18, wherein said means for providing electrical charge or potential to the substrate is adapted to supply said charge or said potential on said substrate.

36. Apparatus according to claim 18, wherein said means for providing electrical charge or potential to the substrate is adapted to supply said charge or said potential on the side of said substrate remote from said member.

37. Apparatus according to claim 18, wherein said means for providing electrical charge or potential to the substrate is adapted to supply said charge or said potential on the side of said substrate adjacent to said member.

38. Apparatus according to claim 18, wherein said means for providing electrical charge or potential to the substrate includes a corotron ion source.

39. Apparatus according to claim 38, wherein said means for providing electrical charge or potential to the substrate further includes an illumination source for providing a pattern of illumination on a substrate comprising a photoconductive material.

40. Apparatus according to claim 18, wherein said means for providing electrical charge or potential to the substrate includes a plurality of electrodes disposed on a side of the substrate remote from the member, each of the electrodes being supplied selectively in use with a respective electrical voltage or charge.

41. Apparatus according to claim 18, wherein said features are arranged in a two-dimensional array.

42. Apparatus according to claim 18, wherein said features are arranged in a line.

43. Apparatus according to claim 18, wherein said means for providing electrical charge or potential to the substrate is adapted to provide said charge or potential in a pattern on said substrate or on the side of said substrate remote from said member.

44. An imaging apparatus for depositing a material species on a substrate to form an image thereon, said species being carried by liquid droplets, wherein the imaging apparatus includes the apparatus according to claim 18.

45. Apparatus for depositing material supplied in the form of a liquid on to a substrate comprising:

a member comprising a flexible membrane having a surface for receiving the liquid, a plurality of features at said surface for locating thereat menisci of the liquid supplied to said member;

liquid supply means for supplying liquid to the member;

an actuator for inducing mechanical vibrations within the liquid located by said features to cause liquid droplets to be formed and sprayed from said member;

means for supplying electrical charge to the liquid before or as said droplets are sprayed from said member; and means for providing electrical charge or potential to the substrate, whereby said droplets are directed towards said substrate to deposit said material thereon.

46. Apparatus for depositing material supplied in the form of a liquid on to a substrate comprising:

a member comprising a flexible membrane having a surface for receiving the liquid, a plurality of features at said surface for locating thereat menisci of the liquid supplied to said member;

liquid supply means for supplying liquid to the member;

a piezoelectric transducer connected to the member to cause said member to vibrate for inducing mechanical vibrations within the liquid located by said features to cause liquid droplets to be formed and sprayed from said member;

means for supplying electrical charge to the liquid before or as said droplets are sprayed from said member; and means for providing electrical charge or potential to the substrate, whereby said droplets are directed towards said substrate to deposit said material thereon.

47. Apparatus for depositing material supplied in the form of a liquid on to a substrate comprising:

a member comprising a flexible membrane having a surface for receiving the liquid, a plurality of features at said surface for locating thereat menisci of the liquid supplied to said member;

liquid supply means for supplying liquid to the member;

a piezoelectric transducer for inducing mechanical vibrations within the liquid located by said features to cause liquid droplets to be directly formed and sprayed from said member;

means for supplying electrical charge to the liquid before or as said droplets are sprayed from said member; and means for providing electrical charge or potential to the substrate, whereby said droplets are directed towards said substrate to deposit said material thereon.

48. Apparatus for depositing material supplied in the form of a liquid on to a substrate comprising:

a member comprising a flexible membrane having a surface for receiving the liquid, a plurality of features at said surface for locating thereat menisci of the liquid supplied to said member;

liquid supply means for supplying liquid to the member;

an actuator for inducing mechanical vibrations within the liquid located by said features to cause liquid droplets to be formed and sprayed from said member;

means for supplying electrical charge to the liquid before or as said droplets are sprayed from said member;

means for providing electrical charge or potential to the substrate, whereby said droplets are directed towards said substrate to deposit said material thereon; and an auxiliary electrode disposed to one side of said member opposite to said surface.

49. Apparatus according to claim 48 wherein said auxiliary electrode includes an insulated layer to insulate said auxiliary electrode from said liquid.

* * * * *